US008040368B2

(12) United States Patent
Yokoi

(10) Patent No.: US 8,040,368 B2
(45) Date of Patent: Oct. 18, 2011

(54) IMAGE FORMING APPARATUS

(75) Inventor: Junichi Yokoi, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 456 days.

(21) Appl. No.: 12/276,800

(22) Filed: Nov. 24, 2008

(65) Prior Publication Data

US 2009/0162091 A1 Jun. 25, 2009

(30) Foreign Application Priority Data

Dec. 25, 2007 (JP) ..... 2007-333356

(51) Int. Cl.
*B41J 15/14* (2006.01)
*B41J 27/00* (2006.01)

(52) U.S. Cl. ..... 347/242; 347/224; 347/225; 347/232; 347/233; 347/238; 347/241; 347/245; 347/256; 347/257; 347/263

(58) Field of Classification Search ..... 347/242, 347/245, 257
See application file for complete search history.

(56) References Cited

U.S. PATENT DOCUMENTS

| | | | | |
|---|---|---|---|---|
| 5,978,626 | A | 11/1999 | Nagamine et al. | |
| 6,029,019 | A * | 2/2000 | Kawai | 399/13 |
| 6,038,417 | A | 3/2000 | Nagamine et al. | |
| 6,219,508 | B1 | 4/2001 | Nagatomi et al. | |
| 6,995,782 | B2 * | 2/2006 | Oda et al. | 347/138 |
| 7,042,591 | B1 * | 5/2006 | Yamazaki et al. | 358/1.5 |
| 7,245,313 | B2 * | 7/2007 | Yamagata | 347/242 |
| 7,388,593 | B2 * | 6/2008 | Fukuda | 347/138 |
| 2003/0222968 | A1 * | 12/2003 | Nagamine | 347/245 |
| 2005/0008394 | A1 * | 1/2005 | Ishii et al. | 399/111 |
| 2005/0046912 | A1 * | 3/2005 | Nobe et al. | 358/498 |
| 2006/0268532 | A1 * | 11/2006 | Kwak | 361/792 |
| 2007/0126852 | A1 * | 6/2007 | Fukutome et al. | 347/262 |

FOREIGN PATENT DOCUMENTS

| | | |
|---|---|---|
| JP | 05-278266 | 10/1993 |
| JP | 11-153893 | 6/1999 |
| JP | 2007-065125 | 3/2007 |

* cited by examiner

*Primary Examiner* — Ryan Lepisto
(74) *Attorney, Agent, or Firm* — Banner & Witcoff, Ltd

(57) ABSTRACT

An image forming apparatus is provided. The image forming apparatus includes: a photosensitive member on which an electrostatic latent image is to be formed; a first body which rotatably supports the photosensitive member; an exposing unit which exposes the photosensitive member; a second body which supports the exposing unit movably between an exposing position in which the exposing unit exposes the photosensitive member and a retracting position in which the exposing unit is retracted from the photosensitive member; a first grounding unit which, when the exposing unit is positioned at the exposing position, causes the exposing unit to be electrically connected to the first body; and a second grounding unit which, when the exposing unit is positioned at the retracting position, causes the exposing unit to be electrically connected to the first body via the second body.

12 Claims, 9 Drawing Sheets

IMAGE FORMING APPARATUS

CROSS-REFERENCE TO RELATED APPLICATION

This application claims priority from Japanese Patent Application No. 2007-333356, filed on Dec. 25, 2007, the entire subject matter of which is incorporated herein by reference.

TECHNICAL FIELD

Aspects of the present invention relate to an image forming apparatus in which an exposing unit such as an LED head is provided movably.

BACKGROUND

In an image forming apparatus, a charged photosensitive drum is irradiated with light, the potential of a portion irradiated with light is changed to form an electrostatic latent image on the photosensitive drum, a developer is supplied to the electrostatic latent image to form a developer image, and the developer image is transferred to a recording sheet, thereby forming an image on the recording sheet.

A related-art image forming apparatus of this type includes: plural LED heads (exposing units) which irradiate plural photosensitive drums with light; an apparatus body which supports the plural photosensitive drums; and a top cover which supports the plural LED heads, and which is pivotable with respect to the apparatus body (see JP-A-2007-65125). In the image forming apparatus, when the top cover is closed, the LED heads are positioned at an exposing position in which the LED heads are close to the photosensitive drums. When the top cover is closed, the LED heads are positioned at a retracting position in which the LED heads are separated from the photosensitive drums.

In the image forming apparatus, in order to prevent electromagnetic waves generated from the LED heads, into which a large current flows to perform lighting, from adversely affecting surrounding devices, grounding springs disposed at the sides of the LED heads are contacted with the apparatus body, thereby electrically grounding the LED heads.

In the above-described related art, in the state in which the top cover is opened, the grounding springs are separated from the apparatus body to cancel grounding of the LED heads. When, in the state in which the top cover is opened, electrostatic charges are accumulated on the LED heads, when the user touches the LED heads, a current flow occurs so that the LED head might be broken. This situation is not restricted in the LED heads, but may occur also in the whole exposing device including a laser scanner and the like.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image forming apparatus in which an exposing unit, such as LED heads, is movable with respect to an apparatus body. Even when the exposing unit is positioned at a retracting position, the exposing unit can be surely grounded.

According to an exemplary embodiment of the present invention, there is provided an image forming apparatus including: a photosensitive member on which an electrostatic latent image is to be formed; a first body which rotatably supports the photosensitive member; an exposing unit which exposes the photosensitive member; a second body which supports the exposing unit movably between an exposing position in which the exposing unit exposes the photosensitive member and a retracting position in which the exposing unit is retracted from the photosensitive member; a first grounding unit which, when the exposing unit is positioned at the exposing position, causes the exposing unit to be electrically connected to the first body; and a second grounding unit which, when the exposing unit is positioned at the retracting position, causes the exposing unit to be electrically connected to the first body via the second body.

According to another exemplary embodiment of the present invention, there is provided an image forming apparatus including: a photosensitive member; an exposing unit which exposes the photosensitive member; a first body which supports the photosensitive member, the first body including a first conductive member; a second body which supports the exposing unit and is movable with respect to the first body between a first state in which the exposing unit opposes the photosensitive member and a second state in which the exposing unit is retracted from the photosensitive member, the second body including a second conductive member; wherein when the second body is in the first state, the exposing unit is electrically connected to the first conductive member without being connected to the second conductive member, and wherein when the second body is in the second state; the exposing unit is electrically connected to the second conductive member without being connected to the first conductive member.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

<Overall Configuration>

Figure 1:
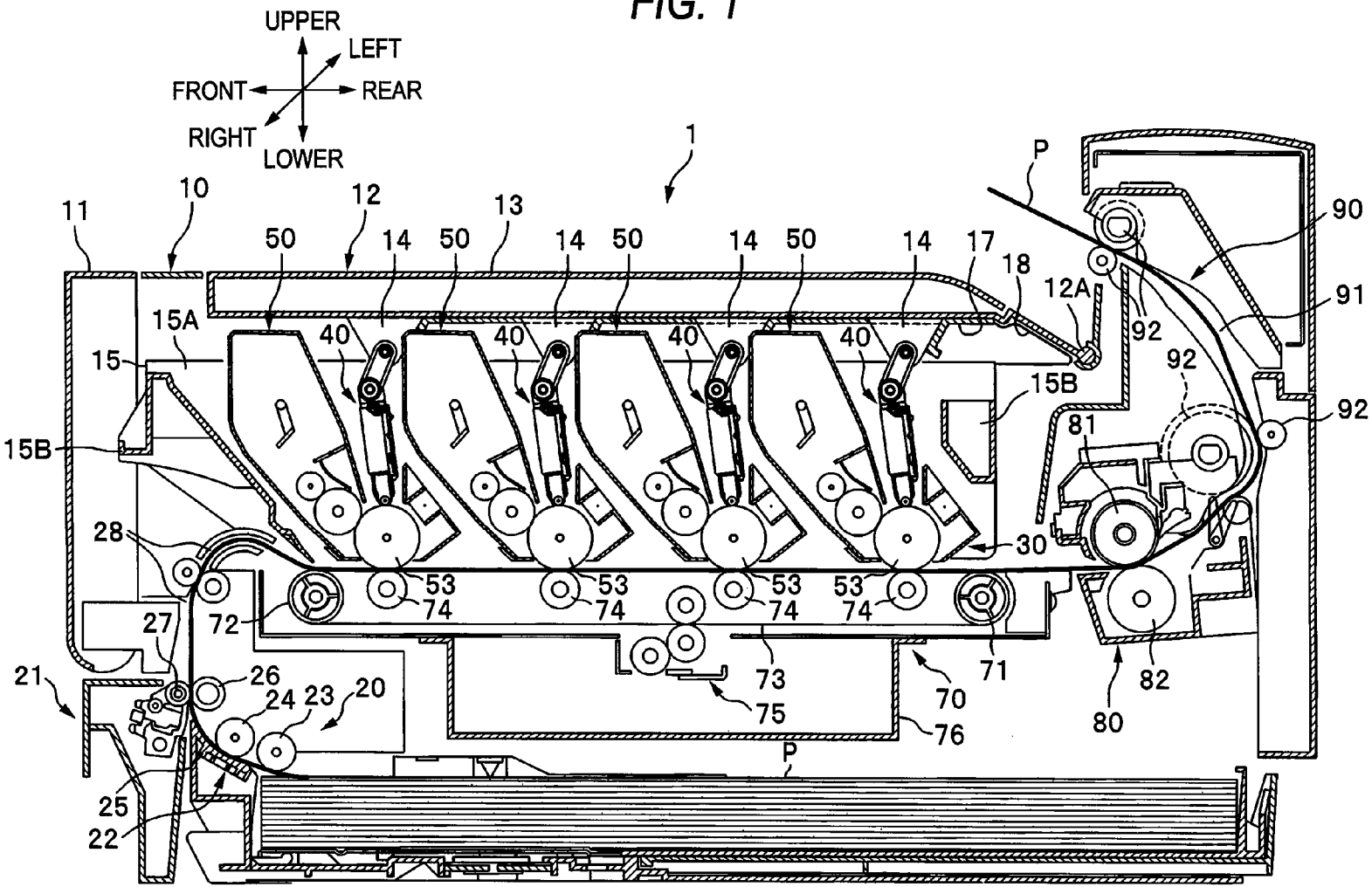
FIG. 1 is a section view showing the whole configuration of a color printer.
Figure 2:
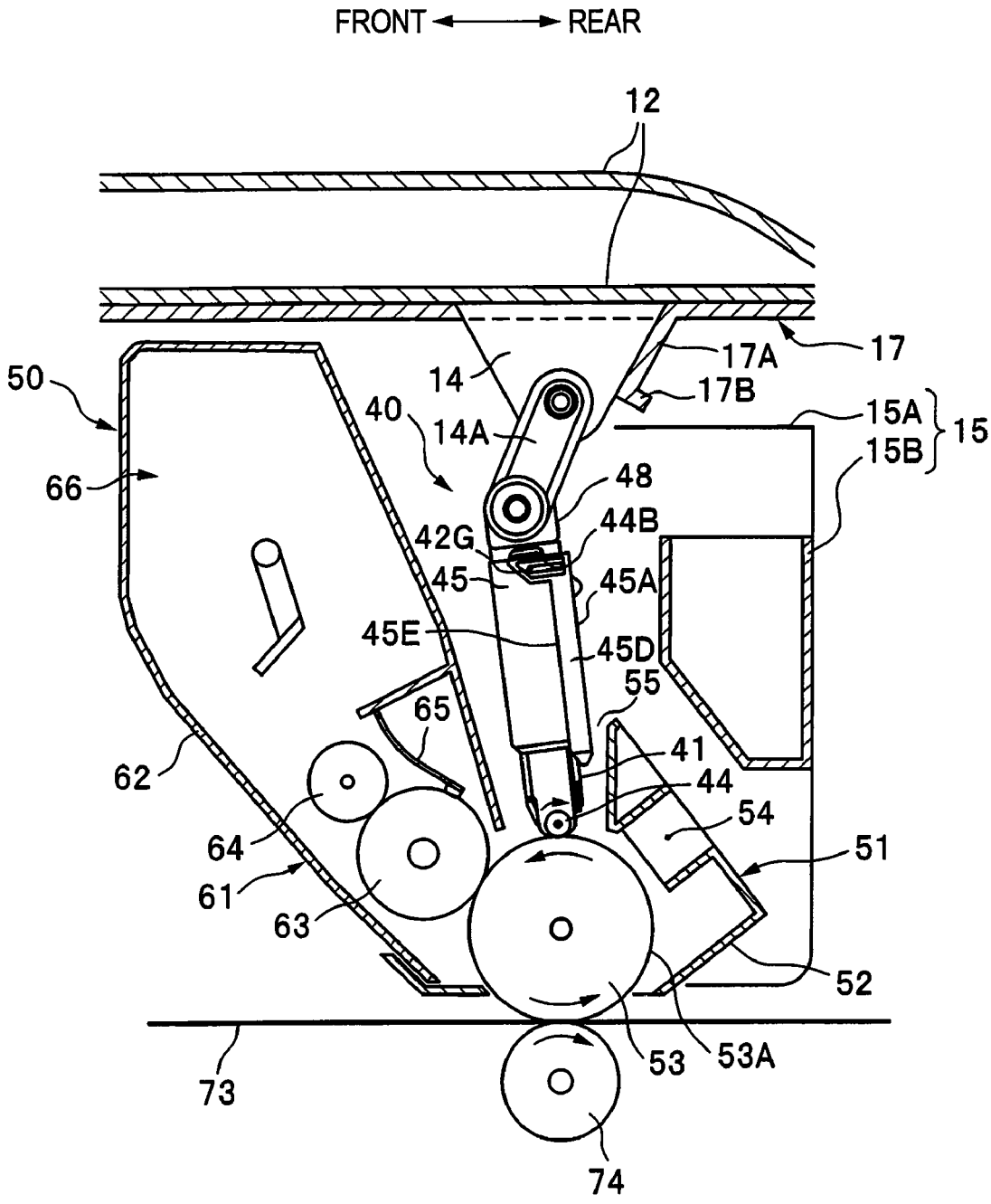
FIG. 2 is an enlarged view of an LED unit and a process cartridge shown in FIG. 1.
Figures 3A, 3B:
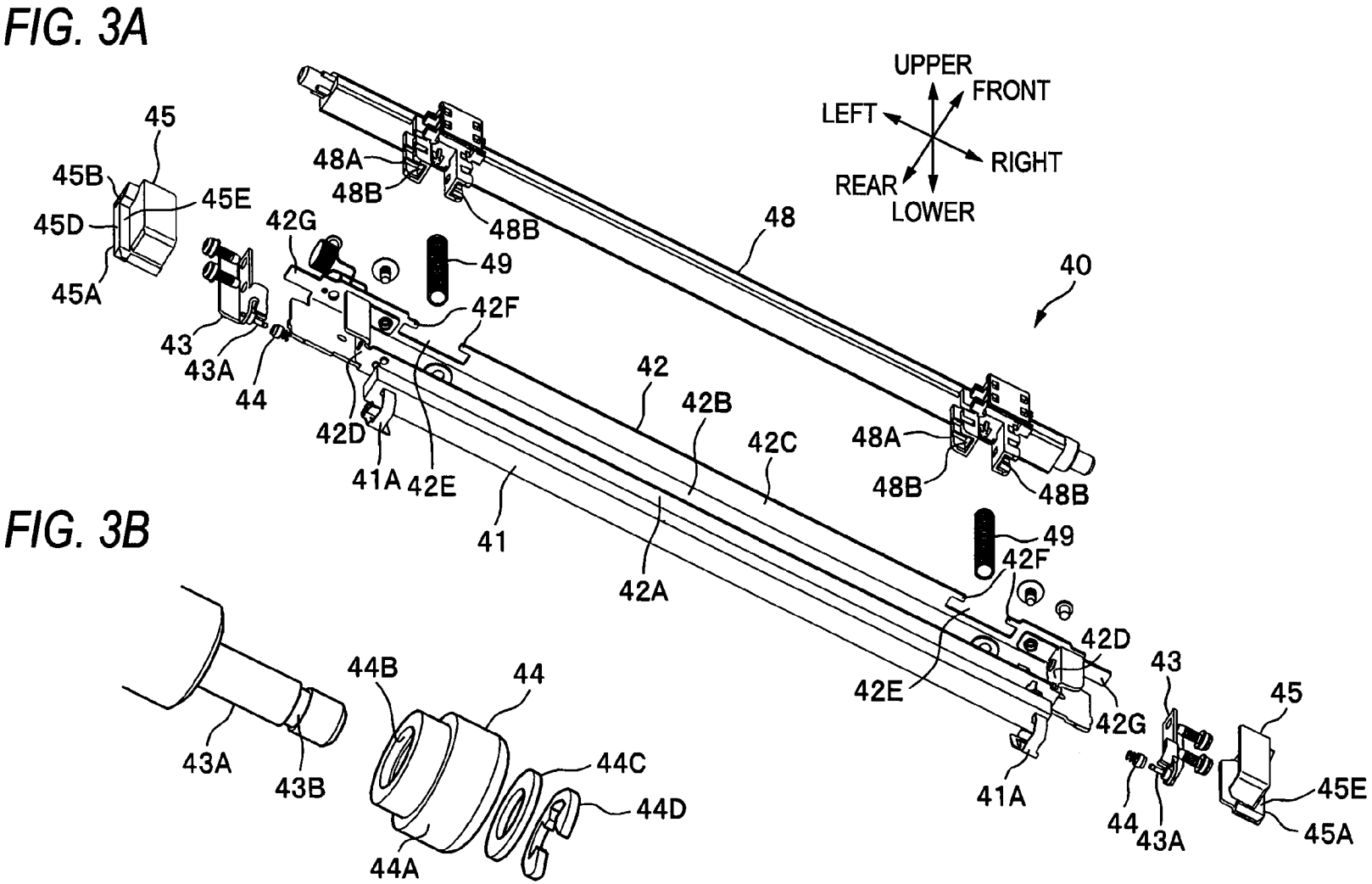
FIG. 3A is an exploded perspective view of the LED unit.
FIG. 3B is an enlarged perspective view of a guide roller.
Figure 4:
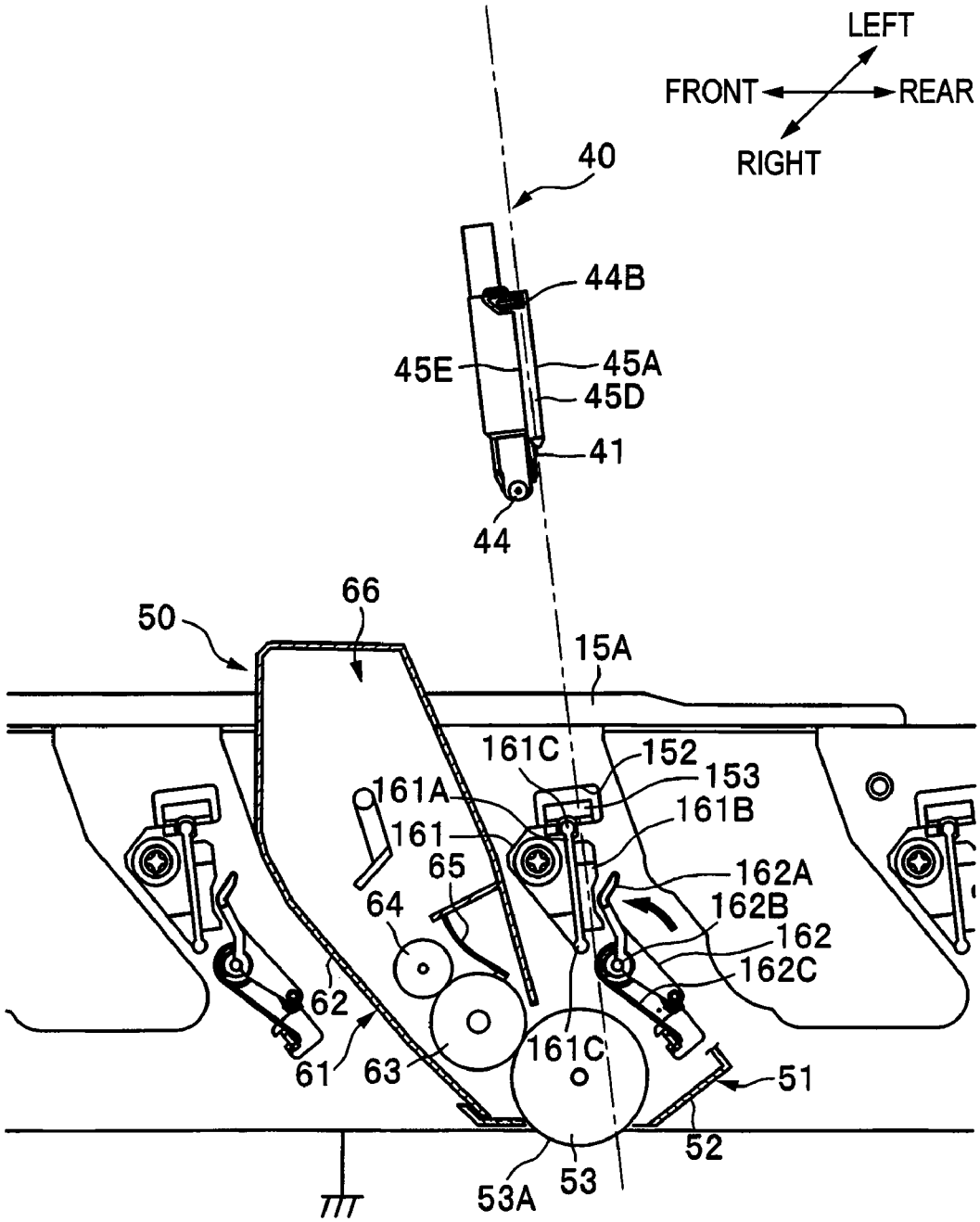
FIG. 4 is a side view showing the positional relationship between the LED unit and a side section.
Figure 5:
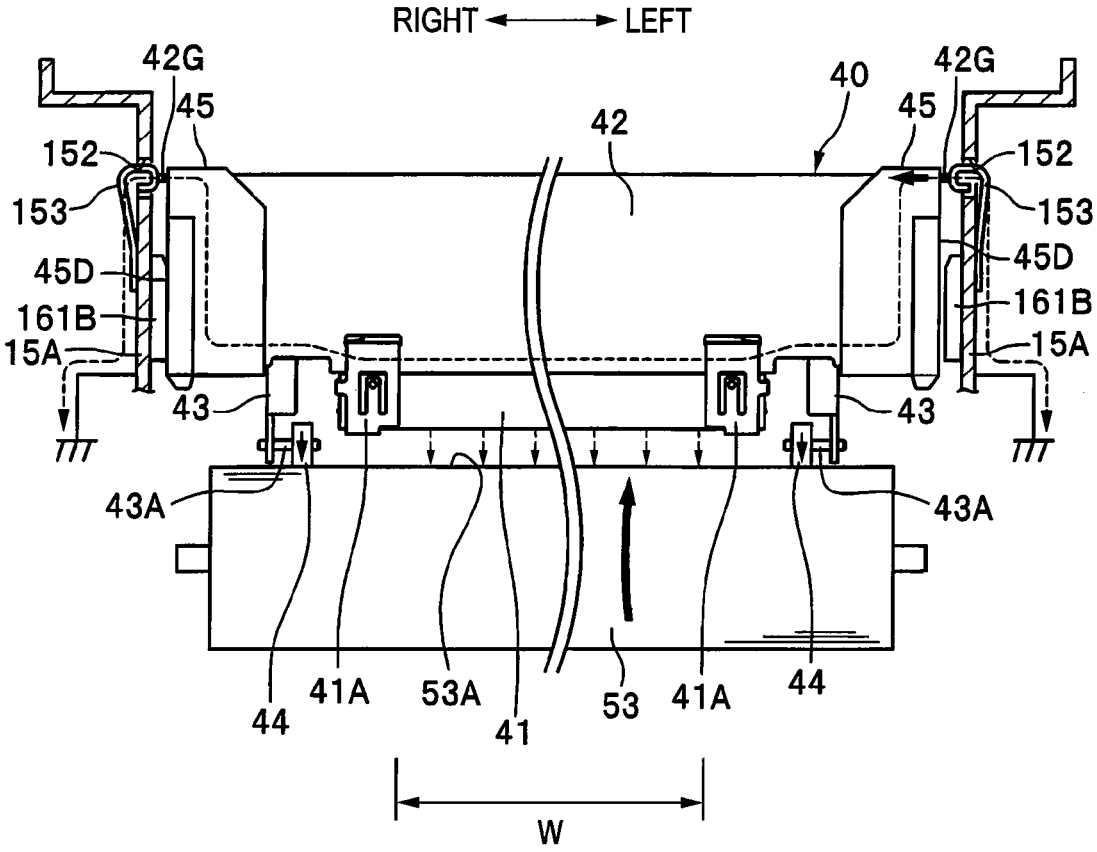
FIG. 5 is a view of a photosensitive drum and the LED unit seen from the rear side.
Figure 6:
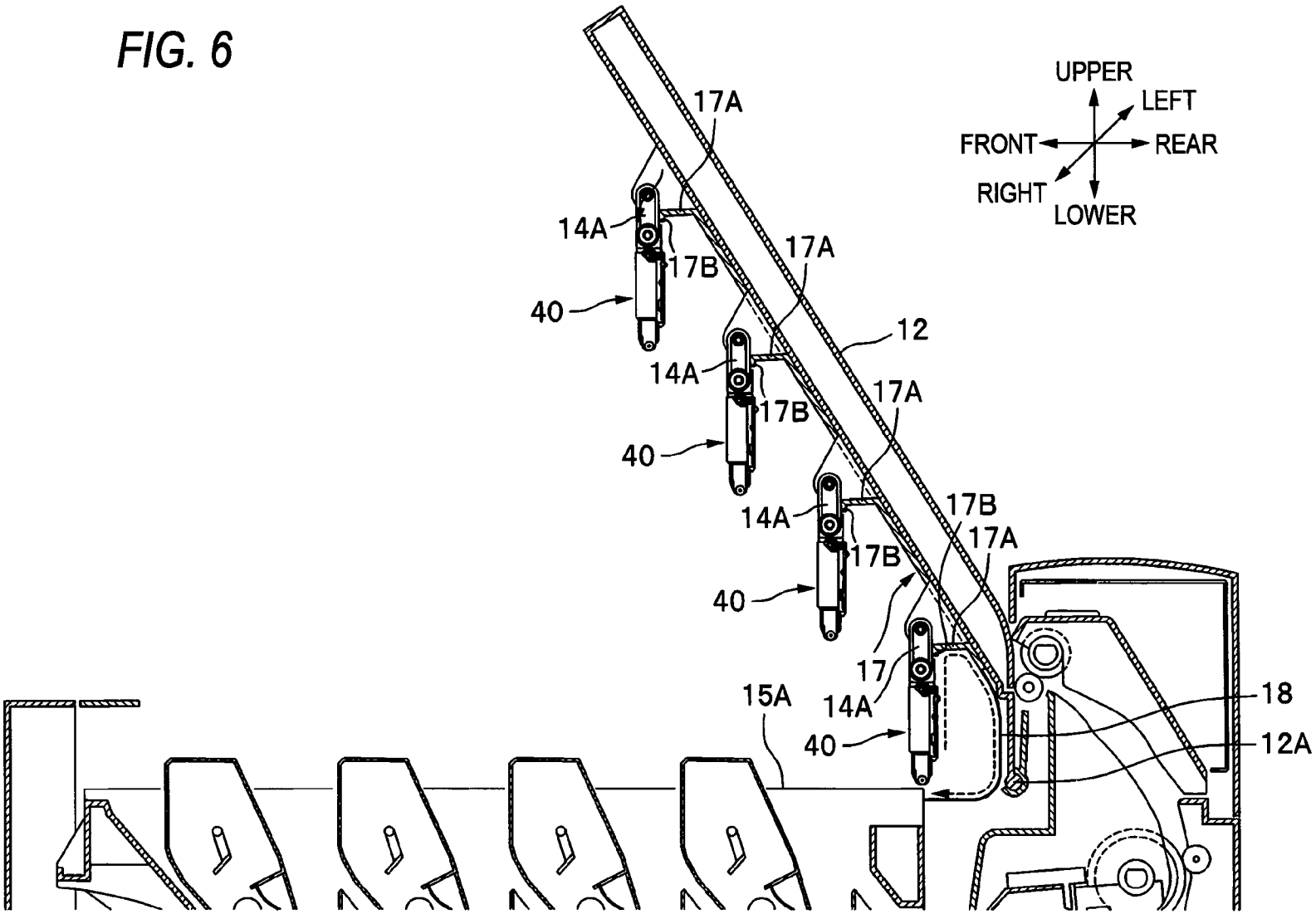
FIG. 6 is a section view showing a grounding state of the LED unit in the case in which an upper cover is opened.

An exemplary embodiment of the present invention will be described in detail with reference to the drawings. Among the drawings to be referred, FIG. 1 is a section view showing the whole configuration of a color printer, FIG. 2 is an enlarged view of an Light Emitting Diode (LED) unit and process cartridge shown in FIG. 1, FIG. 3A is an exploded perspective view of the LED unit, FIG. 3B is an enlarged perspective view of a guide roller, FIG. 4 is a side view showing the positional relationship between the LED unit and a side section, FIG. 5 is a view of a photosensitive drum and the LED unit seen from the rear side, and FIG. 6 is a section view showing a grounding state of the LED unit in the case in which an upper cover is opened In the following description, the indication of the direction is taken with reference to the user using the color printer. That is, in FIG. 1, it is assumed that the left side when viewing the figure is "front", the right side when viewing the figure is "rear", the back side when viewing the figure is "left", and the front side when viewing the figure is "right". Furthermore, it is assumed that the vertical direction when viewing the figure is "upper and lower direction".

As shown in FIG. 1, the color printer 1 includes: a sheet feeding unit 20 which feeds a sheet P; an image forming unit 30 which forms an image on the fed sheet P; and a sheet discharging unit 90 which discharges the sheet P on which an image is formed in a body case 10.

A front cover 11 is provided at front portion of the body case 10 to be pivotable in the front and rear direction about a lower portion thereof. In an upper portion of the body case 10, an upper cover 12 which is openable and closable with respect to the body case 10 is provided so as to be vertically pivotable about a hinge 12A disposed in the rear side. The upper face of the upper cover 12 is formed as a sheet discharging tray 13 on which sheets P discharged from the body case 10 is stacked, and, on the lower face, plural LED attaching members 14 for supporting LED units 40 that will be described later are disposed.

A body frame 15 which detachably houses process cartridges 50 that will be described later, and which constitutes a part of the apparatus body is disposed in the body case 10. In the body frame 15, a pair of metal side frames 15A which are disposed in the right and left sides (only one frame is shown), and a pair of front and rear cross members 15B which couple the pair of side frames 15A with each other are disposed. That is, the body case 10 includes metal.

The body frame 15 is fixed to the body case 10 and the like. The side frames 15A are placed respectively on the both sides of an arrangement direction of light emitting portions of LED heads 41, which will be described later, and directly or indirectly support and position the photosensitive drums 53. The arrangement direction of the light emitting portions of the LED heads 41 is referred to as a main scanning direction, and identical with the axial directions of photosensitive drums 53 in this exemplary embodiment.

The sheet feeding unit 20 includes: a sheet feeding tray 21 which is disposed in a lower portion of the body case 10, and which is detachably attached to the body case 10; and a sheet feeding mechanism 22 which conveys the sheet P from the sheet feeding tray 21 to the image forming unit 30. The sheet feeding mechanism 22 is disposed in front of the sheet feeding tray 21, and includes a feed roller 23, a separation roller 24, and a separation pad 25.

In the thus configured sheet feeding unit 20, sheets P in the sheet feeding tray 21 are upwardly fed while being individually separated from one another, sheet dusts are removed away during a process in which the sheet P is passed between a sheet dust removing roller 26 and a pinch roller 27, and then the sheet is passed through a conveying path 28 to convert the direction of the sheet to the rearward direction, and fed to the image forming unit 30.

The image forming unit 30 includes four LED units 40, four process cartridges 50, a transferring unit 70, and a fixing unit 80.

The process cartridges 50 are arranged in the longitudinal direction between the upper cover 12 and the sheet feeding unit 20 as shown in FIG. 2. Each of the process cartridges 50 includes a drum unit 51, and a developing unit 61 which is detachably attached to the drum unit 51. The process cartridges 50 are supported by the side frames 15A, and the photosensitive drums 53 are supported by the process cartridges 50, respectively. The process cartridges 50 are different only in colors of toners housed in respective toner housing chambers 66 of the developing units 61, and have the similar configuration.

The drum unit 51 includes a drum frame 52, the photosensitive drum 53 which is rotatably supported by the drum frame 52, and a scorotron charger 54. In a state in which the drum unit 51 is attached to the body case 10, the photosensitive drum 53 is supported rotatably with respect to the body case 10 through the drum frame 52 and the side frames 15A.

The developing unit 61 is attached to the drum frame 52, thereby defining an exposing space 55 through which the photosensitive drum 53 can be seen from the upper side. The LED unit 40 is inserted through the exposing space 55.

The developing unit 61 includes a developing frame 62, a developing roller 63 and supplying roller 64 which are rotatably supported by the developing frame 62, and a layer-thickness regulating blade 65, and has the toner housing chamber 66 which houses the toner.

As shown in FIG. 1, the transferring unit 70 is disposed between the sheet feeding unit 20 and the process cartridges 50, and includes a driving roller 71, a driven roller 72, a conveyor belt 73, transfer rollers 74, and a cleaning unit 75.

The driving roller 71 and the driven roller 72 are placed in parallel while being separated from each other, in the longitudinal direction. The conveyor belt 73 configured by an endless belt is wound around the driving roller 71 and the driven roller 72. The outer surface of the conveyor belt 73 is in contact with the photosensitive drums 53. Inside the conveyor belt 73, four transfer rollers 74 which cooperate with the photosensitive drums 53 to sandwich the conveyor belt 73 are placed so as to be opposed to the respective photosensitive drums 53. During a transfer process, a transfer bias is applied to the transfer rollers 74 by a constant-current control.

The cleaning unit 75 is disposed under the conveyor belt 73. The cleaning unit 75 removes toner adhering to the conveyor belt 73 to drop the toner to a toner storing unit 76 disposed under the cleaning unit 75.

The fixing unit 80 is disposed at rear side from the process cartridges 50 and the transferring unit 70, and includes a heating roller 81, and a pressing roller 82 which is opposed to the heating roller 81 to press the heating roller 81.

In the thus configured image forming unit 30, first, the surface of each of the photosensitive drums 53 is uniformly charged by the scorotron charger 54, and then exposed by LED beams emitted from the corresponding LED unit 40. Therefore, the potential of the exposed portion is lowered, and an electrostatic latent image based on image data is formed on the photosensitive drum 53.

The toner in the toner housing chamber 66 is supplied to the developing roller 63 by rotation of the supplying roller 64, and caused by rotation of the developing roller 63 to enter between the developing roller 63 and the layer-thickness regulating blade 65 and carried on the developing roller 63 as a thin layer of a constant thickness.

When the developing roller 63 is opposed to and contacted with the photosensitive drum 53, the toner carried on the developing roller 63 is supplied to the electrostatic latent image formed on the photosensitive drum 53. Therefore, the toner is selectively carried on the photosensitive drum 53 to visualize the electrostatic latent image, and a toner image is formed by the reversal development.

The sheet P fed onto the conveyor belt 73 is passed between the photosensitive drums 53 and the transfer rollers 74 placed inside the conveyor belt 73, so that the toner images formed on the photosensitive drums 53 are transferred to the sheet P.

When the sheet P is passed between the heating roller 81 and the pressing roller 82, the toner images transferred to the sheet P are thermally fixed thereto.

The sheet discharging unit 90 includes: a discharge conveying path 91 which is formed so as to upwardly extend from the outlet of the fixing unit 80, and to be then inverted toward the front side; and plural pairs of conveying rollers 92 which convey the sheet P. The sheet P onto which the toner images have been transferred, and which has undergone the thermal fixing process is conveyed through the discharge conveying path 91 by the conveying rollers 92, and then discharged to the outside of the body case 10 to be stacked on the sheet discharging tray 13.

<Configuration of LED Unit>

Next, the LED units 40 and the configuration for grounding the LED units 40 will be described in detail. Herein, the grounding the LED unit 40 refers to a state in which the LED unit 40 is electrically connected to the ground and a state in which the LED unit 40 is electrically connected to a conductor, such as metal side frames 15A or a metal upper panel 17 to be described later, so that a reference potential of the LED head 41 and a potential of the conductor become same.

As shown in FIG. 3, each of the LED units 40 includes the LED head 41, a frame 42, roller support members 43, guide rollers 44, resin covers 45, and a suspender 48.

The LED head 41 includes laterally arranged plural light emitting portions each configured by an LED, in one row in the lower side. Specifically, the LED head 41 has a head structure in which plural LEDs (light emitting elements) that are arranged in accordance with predetermined pixel pitches, and that are selectively driven to expose the surface of the photosensitive drum 53 are supported by a supporting member. In this exemplary embodiment, the arrangement direction of the light emitting portions is referred to as the main scanning direction, and the direction perpendicular to the main scanning direction, which is the longitudinal direction along which the photosensitive drums 53 are arranged is referred to as the sub scanning direction. The exterior of the LED head 41 is formed by a resin, so that discharges from high-voltage components such as the scorotron charger 54 are suppressed. The light emitting portions receive a signal from a control device (not shown) on the basis of data of an image to be formed, and emits light to expose the photosensitive drum 53.

The frame 42 covers the LED head 41. The frame 42 is formed by pressing a metal plate into a substantially U-like section and is electrically conductive. The frame 42 is formed to be longer than the LED head 41 in the axial direction of the photosensitive drum 53, i.e., the lateral direction. Specifically, the frame 42 includes a lower section 42A, a side section 42B, and an upper section 42C to have U-like section shape and extend in the lateral direction. In the both ends of the lower section 42A in the lateral direction (hereinafter, the ends are also referred to as "the both ends"), end sections 42D are formed by bending end portions of the lower section 42A. In the upper section 42C, openings 42E which are opened in the front side are formed in the vicinities of the both ends. In the front side or opening end of each of the openings 42E, engaging hooks 42F which laterally extend toward the inner side of the opening 42E so as to narrow the opening 42E are formed. While the upper face is closely contacted with the lower section 42A of the frame 42, the above-described LED head 41 is attached and fixed by two clips 41A to the frame 42.

Both ends in the lateral direction of the upper section 42C of the frame 42 project to form grounding terminals 42G.

Each of the roller support member 43 is a bracket which is formed by performing a pressing process on a conductive metal plate, and which is screwed to the corresponding one of the end sections 42D of the frame 42. In the roller support member 43, a roller shaft 43A which laterally extends toward the inner side is disposed in the lower end. The roller shaft 43A rotatably supports the guide roller 44. As shown in FIG. 3B, an engaging groove 43B is formed in the circumferential direction.

The guide roller 44 is a substantially cylindrical roller. Specifically, a rolling face 44A is formed into a cylindrical shape. A shaft hole 44B into which the roller shaft 43A is to be fitted is formed in the central axis of the rolling face 44A. The roller shaft 43A is passed through the shaft hole 44B, a washer 44C is inserted, and then a clip 44D is engaged with the engaging groove 43B, whereby the guide roller 44 is attached to the roller shaft 43A. That is, the extending direction of the roller shaft 43A coincides with the rotation axis direction of the guide roller 44.

As shown in FIG. 2, the guide roller 44 rolls while contacting with the peripheral face 53A of the photosensitive drum 53, to define the positional relationship between the LED unit 40 and the photosensitive drum 53, and specifically, the gap between the light emitting portions of the LED head 41 and the peripheral face 53A. The material constituting the guide roller 44 is not particularly limited. Preferably, a material which has an adequate coefficient of friction with respect to the peripheral face 53A, and which has an excellent wear resistance, such as a polyamide resin may be used.

In order to reduce or prevent the image formation from being influenced, the guide roller 44 is placed outside the image forming range (indicated by the reference character W in FIG. 5) to which the toner is supplied, on the peripheral face 53A of the photosensitive drum 53.

The resin covers 45 are disposed in the right and left ends of the frame 42 symmetrically with each other. The resin covers 45 are configured by insulative resin members, and formed so as to cover the end faces of the frame 42 and portions of predetermined range from the both ends, respectively. In each of the resin covers 45, a guide rib 45A which vertically extends is projected in a lateral outer end portion. The upper end of the guide rib 45A has a substantially triangular profile as seen from the lateral end side. A through hole 45B is formed in the inner side of the triangular portion. The corresponding one of the grounding terminals 42G passes through the through hole 45B to be exposed therefrom.

The lateral end faces of the guide ribs 45A serve as main scanning direction positioning faces 45D.

The main scanning direction positioning faces 45D abut against the side frames 15A by a plate spring 153 (see FIG. 5), which will be described later, in the main scanning direction to position the LED unit 40 in the main scanning direction. The front faces of the guide ribs 45A serve as sub scanning direction positioning faces 45E. The sub scanning direction positioning faces 45E abut against the side frames 15A in the sub scanning direction to position the LED unit 40 in the sub scanning direction.

The suspender 48 is a metal member which supports the frame 42 and the LED head 41 in a suspended state. The suspender 48 is formed so that the lateral length is equal to that of the frame 42, and an engaging member 48A is disposed at two places respectively corresponding to the two openings 42E. In each of the engaging members 48A, portions which have a U-like section shape, and which are opened toward the laterally outer side as seen from the lower side are formed, and openings 48B of the U-like sections are loosely engaged with the engaging hooks 42F, respectively.

Compression springs 49 are placed between the engaging members 48A and the frame 42. The compression springs 49 are placed laterally inside the respective two guide rollers 44. After the engaging members 48A are loosely engaged with the openings 42E and engaging hooks 42F of the frame 42, they are locked by locking members (not shown), and then the frame 42 and the LED head 41 are downwardly urged by the compression springs 49 at any time. The frame 42 is electrically connected to the suspender 48 thorough the compression springs 49 and the engaging members 48A.

As shown in FIG. 2, the LED unit 40 is attached to the upper cover 12 through a connecting link 14A and an LED attaching member 14. In connecting portions between the connecting link 14A and the LED attaching member 14, and between the connecting link 14A and the LED unit 40, the connecting link 14A is pivotable in a side view of FIG. 2. According to this configuration, the posture of the LED unit 40 can be freely changed. Therefore, the LED unit 40 can be easily engaged with the side frames 15A.

In the state where the LED unit 40 is attached to the upper cover 12, the LED unit downwardly extends from the upper cover 12. Since, as described above, the upper cover 12 can pivot about the hinge 12A of the rear side so as to be openable and closable, the photosensitive drum 53 and the LED unit 40 can be relatively moved between an exposing position in which they are close to each other, and a retracting position in which they are separated from each other.

A metal upper panel 17 is disposed on the lower face of the upper cover 12. That is, the upper cover 12 includes a metal. In the upper panel 17, plural link receiving units 17A (only one unit is shown) are formed correspondingly with the LED units 40 by cutting and bending operations or the like. A tip end portion 17B of each of the link receiving units 17A is bent so as to support the peripheral edge of the connecting link 14A when the upper cover 12 is opened. According to this configuration, the LED unit 40 is displaced with respect to the upper cover 12 in accordance with movement of the upper cover 12, so that, when the LED unit 40 is positioned at the exposing position, the connecting link 14A is separated from the link receiving unit 17A, and, when the LED unit 40 is positioned at the retracting position, the connecting link 14A is in contact with the link receiving unit 17A (see FIG. 6). As shown in FIG. 6, the upper panel 17 is electrically connected to the side frame 15A via a conductor cable 18 which is laid so as to pass the vicinity of the hinge 12A of the upper cover 12.

As shown in FIG. 4, each of the side frames 15A has a front guide 161 and a rear guide 162 correspondingly with both end portions of each of the four LED units 40 at the position where the LED unit 40 is mounted. The front guide 161 is to be placed in front of the sub scanning direction positioning face 45E, and the rear guide 162 is placed to be rear of the sub scanning direction positioning face 45E.

In the front guide 161, a rib 161A which extends substantially vertically projects inwardly in the lateral direction. When the LED unit 40 is mounted, the rib 161A is positioned in front of the guide rib 45A. Upper and lower end portions of the rib 161A are formed as columnar portions 161C having a columnar shape so as to be thicker than a middle portion thereof. The columnar portions 161C abut against the sub scanning direction positioning face 45E to position the LED unit 40 in the sub scanning direction. On the rear edge of the front guide 161, an abutting portion 161B is disposed along the rib 161A. The abutting portion 161B is a face against which the main scanning direction positioning face 45D of the LED unit 40 is abuttable. The right-side abutting portion 161B abuts against one end side of the LED unit 40 to regulate the lateral position of the LED unit 40.

An arm 162A which extends from the lower side toward the upper side is disposed on the rear guide 162. The arm 162A is pivotably supported at a swing shaft 162B by the metal plate of the side frame 15A. A torsion spring 162C is disposed in the periphery of the swing shaft 162B so that an urging force in a counterclockwise direction in FIG. 4 is applied to the arm 162A by the torsion spring 162C at any time.

Both the front and rear guides 161, 162 are made of a resin, whereby abrasion due to sliding contact with the LED unit 40 is suppressed.

In each of the side frames 15A, an opening 152 corresponding to the grounding terminal 42G of the LED unit 40 which is at the exposing position is formed substantially above the abutting portion 161B. As shown in FIG. 5, a plate spring 153 which is formed by bending a conductive metal plate is disposed in the opening 152.

The plate spring 153 abuts against the grounding terminal 42G of the LED unit 40 to be bent, thereby generating an urging force in the lateral inner direction. The plate springs 153 on the right and left sides are set so that the left one (the right one in FIG. 5) is thicker than the right one (the left one in FIG. 5) so as to exert a larger urging force. As shown in FIGS. 4 and 5, the side frames 15A are electrically grounded.

Figure 7:
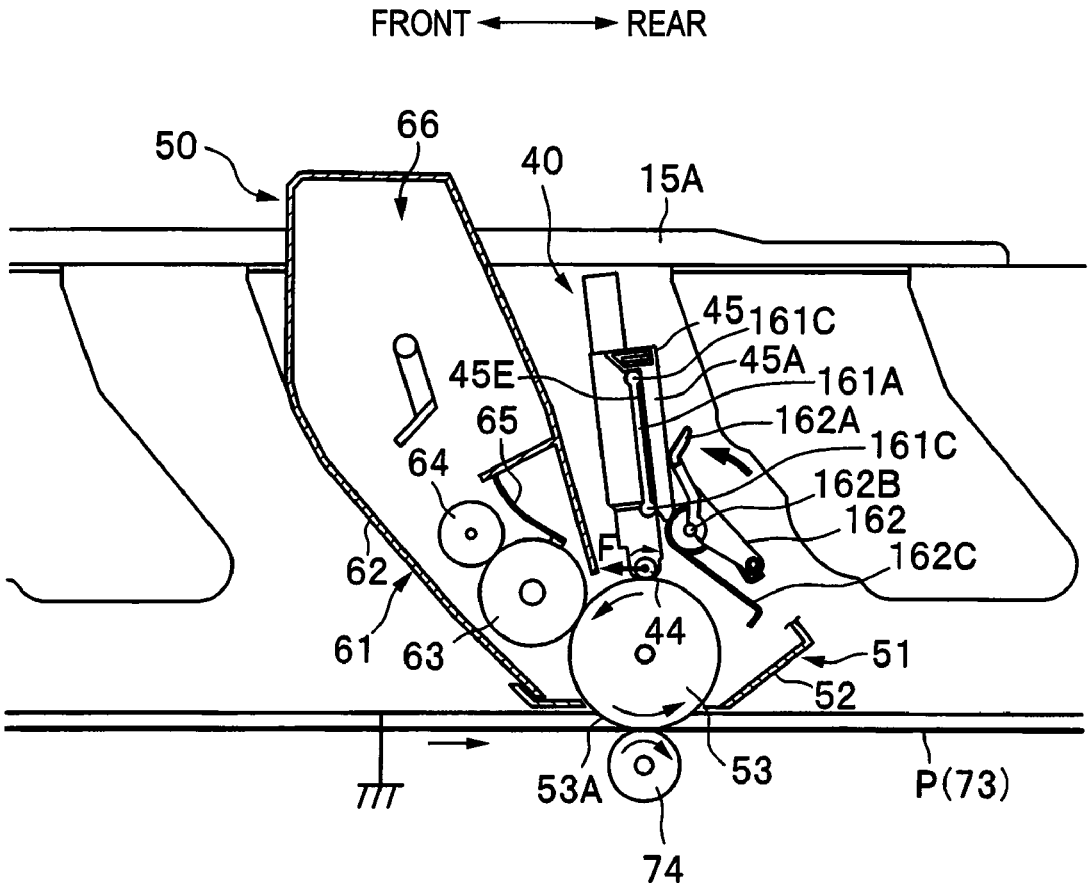
FIG. 7 is a view illustrating the positioning in a sub scanning direction in the case in which the LED unit is positioned at an exposing position.

Next, the grounding state of the LED unit 40 in the case in which the upper cover 12 is closed, and the grounding state of the LED unit 40 in the case in which the upper cover 12 is opened will be described. In the figures to be referred, FIG. 7 is a view illustrating the positioning in the sub scanning direction in the case in which the LED unit is positioned at the exposing position.

<Grounding State of LED Unit in the Case in which the Upper Cover is Closed>

When the upper cover 12 in the opened state is lowered to the close position, as shown in FIG. 2, the guide rollers 44 which are at the tip end (lower end) of each of the LED units 40 abut against the peripheral face 53A of the photosensitive drum 53, whereby the distance between the peripheral face 53A and the light emitting portions of the LED head 41 is kept constant.

In the LED unit 40 inserted to the exposing position, as sown in FIG. 5, the right and left grounding terminals 42G abut against the respective plate springs 153, and urged laterally inwardly from the both sides. Since the urging force of the left plate spring 153 is larger than that of the right plate spring 153, the LED unit 40 is shifted to right as a whole, and the right abut portion 161B and the right main scanning direction positioning face 45D abut against each other, so that the LED unit 40 is positioned in the main scanning direction.

As shown in FIG. 7, the guide ribs 45A are inserted between the ribs 161A and the arms 162A. The arms 162A pivot about the swing shafts 162B by the torsion springs 162C, respectively, and urged in a counterclockwise direction in FIG. 7, i.e., in the forward direction, so that the guide ribs 45A are forwardly urged. Therefore, the sub scanning direction positioning faces 45E of the guide ribs 45A abut against the columnar portions 161C at the both ends of the ribs 161A, thereby positioning the LED unit 40 in the sub scanning direction.

In the above-described positioning in the main scanning direction, the LED unit 40 is electrically grounded via the grounding terminals 42G of the frame 42, the plate springs 153, and the side frames 15A.

<Grounding State of LED Unit in the Case in which Upper Cover is Opened>

When the upper cover 12 in the closed state is lifted to the open position, as shown in FIG. 6, each of the LED units 40 is moved to retracting position, and the LED unit 40 and the corresponding connecting link 14A are caused to have a posture which extend in the vertical direction, by the gravity. At this time, each of the connecting links 14A abuts against the link receiving unit 17A of the upper panel 17 to be supported by the link receiving unit 17A. According to this configuration, the LED unit 40 is electrically grounded via the frame 42, the compression springs 49, the engaging members 48A, the suspender 48, the connecting link 14A, the upper panel 17, and the side frames 15A.

According to the above-described exemplary embodiment, even when the upper cover 12 is in any of the closed and opened states (the LED unit 40 is at any of the exposing and retracting positions), the LED unit 40 can be surely grounded.

Since the LED unit 40 positioned at the retracting position is grounded by using the upper panel 17 disposed in the upper cover 12, the number of wirings can be reduced and the structure can be simplified as compared with the structure in which, for example, grounding is performed by directly connecting wirings drawn out from the LED units 40 to metal portions on the side of the body case 10.

When the LED unit 40 is positioned at the exposing position, it is separated from the upper panel 17, and hence it is possible to prevent a grounding loop from being formed, so that grounding can be satisfactorily performed. Herein, the grounding loop means an electric path which is formed, for example, if in the exemplary embodiment, the LED unit 40 positioned in at the exposing position would be connected to the upper panel 17. Specifically, in this case, the electric path starts from the grounding terminal 42G of the frame 42 of the LED unit 40 and returns to the frame 42 via the plate spring 153, the side frame 15A, the conductor cable 18, the upper panel 17, the connecting link 14A, the suspender 48, the engaging member 48A, and the compression spring 49. When such a grounding loop is formed, electromagnetic waves may be emitted, and there arises a possibility that an external apparatus or a circuit in the printer malfunctions.

The LED unit 40 is grounded by using the grounding terminals 42G and the plate springs 153 which is used for positing the LED unit 40. Therefore, the structure can be simplified as compared with the structure where a portion for positioning the LED unit 40 and that for grounding are configured as separate components.

The grounding terminals 42G and the plate springs 153 are disposed on the both lateral sides of the LED unit 40. Therefore, the LED unit 40 can be satisfactorily grounded in the both lateral sides.

Since the exterior of the LED head 41 is made of a resin, the shape can be freely changed, so that the LED head 41 can be miniaturized, and the degree of freedom in the layout around the photosensitive drum 53 is enhanced, whereby the size of the color printer 1 can be reduced.

Furthermore, the metal frame 42 is formed above the LED head 41 so as to be laterally larger than the LED head 41, and the metal side frames 15A are disposed on the both lateral sides of the LED head 41. Therefore, even when a large current flows through the LED head 41 and electromagnetic waves are generated, the electromagnetic waves are sufficiently absorbed by theses members, so that influences of the electromagnetic waves on the other devices can be suppressed. In the exemplary embodiment, the above-described configuration is employed on the both lateral sides, and hence grounding and absorption of electromagnetic waves can be sufficiently conducted. Furthermore, the grounding terminals 42G are used in the positioning in the main scanning direction, and hence positioning and grounding of the LED head 41 and blocking of electromagnetic waves can be simultaneously conducted.

While the present invention has been shown and described with reference to certain exemplary embodiments thereof, it will be understood by those skilled in the art that various changes in form and details may be made therein without departing from the spirit and scope of the invention as defined by the appended claims.

Figure 8:
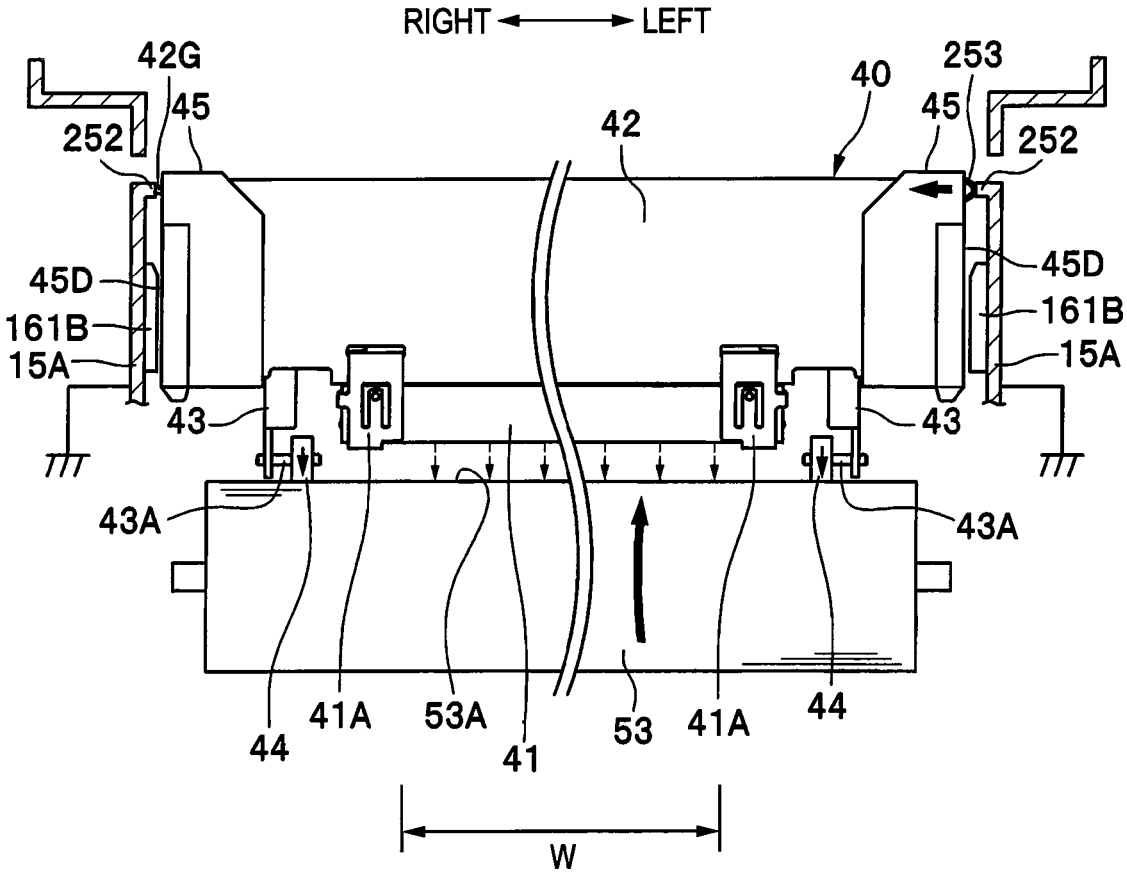
FIG. 8 is a view of an example in which a method of positioning in a main scanning direction is changed, and which corresponds to FIG. 5.

For example, FIG. 8 is a view of an example in which the method of positioning in the main scanning direction is changed, and which corresponds to FIG. 5. The components which are not described below are configured in the same manner as the above-described exemplary embodiment. In the example of FIG. 8, the plate spring 153 on the right side (the left side in FIG. 8) is omitted, and the side frame 15A is bent laterally inwardly, so that an abutting portion 252 is formed at a position corresponding to the grounding terminal 42G. Moreover, the plate spring 153 on the left side (the right side in FIG. 8) is omitted, a abutting portion 252 is formed in the same manner as the right side, and a metal plate spring 253 which is attached to the frame 42, and which is outwardly projected from the through hole 45B of the resin cover 45 is disposed. Also in this configuration, the LED unit 40 is urged to right by the urging force of the plate spring 253, so that the positioning in the main scanning direction is performed and at the same time grounding of the LED head 41 is ensured. Specifically, in the right side, the LED unit is grounded from the frame 42 via the grounding terminal 42G and the abutting portion 252, and, in the left side, grounded from the frame 42 via the plate spring 253 and the abutting portion 252.

In the exemplary embodiment described above, as an example of an exposing device, the configuration which has plural LEDs as the plural light emitting portions has been exemplarily described. In order to configure the plural light emitting portions, alternatively, only one light emitting element such as an LED may be used. For example, one back light such as a fluorescent lamp, and an optical shutter in which liquid crystal devices or PLZT elements are laterally arranged in one row may configure the plural light emitting portions. The light emitting portions may not be laterally arranged in one row, but may be arranged in plural rows. The light emitting elements are not limited to LEDs, and may be OLED (Organic Light Emitting Diode) elements, fluorescence elements, or the like.

The side frames 15A (the body frame 15) which are placed on the both sides of the photosensitive drum 53 may be configured by frames themselves of the color printer 1, or frames of a drawer which attaches and detaches plural process cartridges 50 in bundle to and from the color printer 1.

Figure 9:
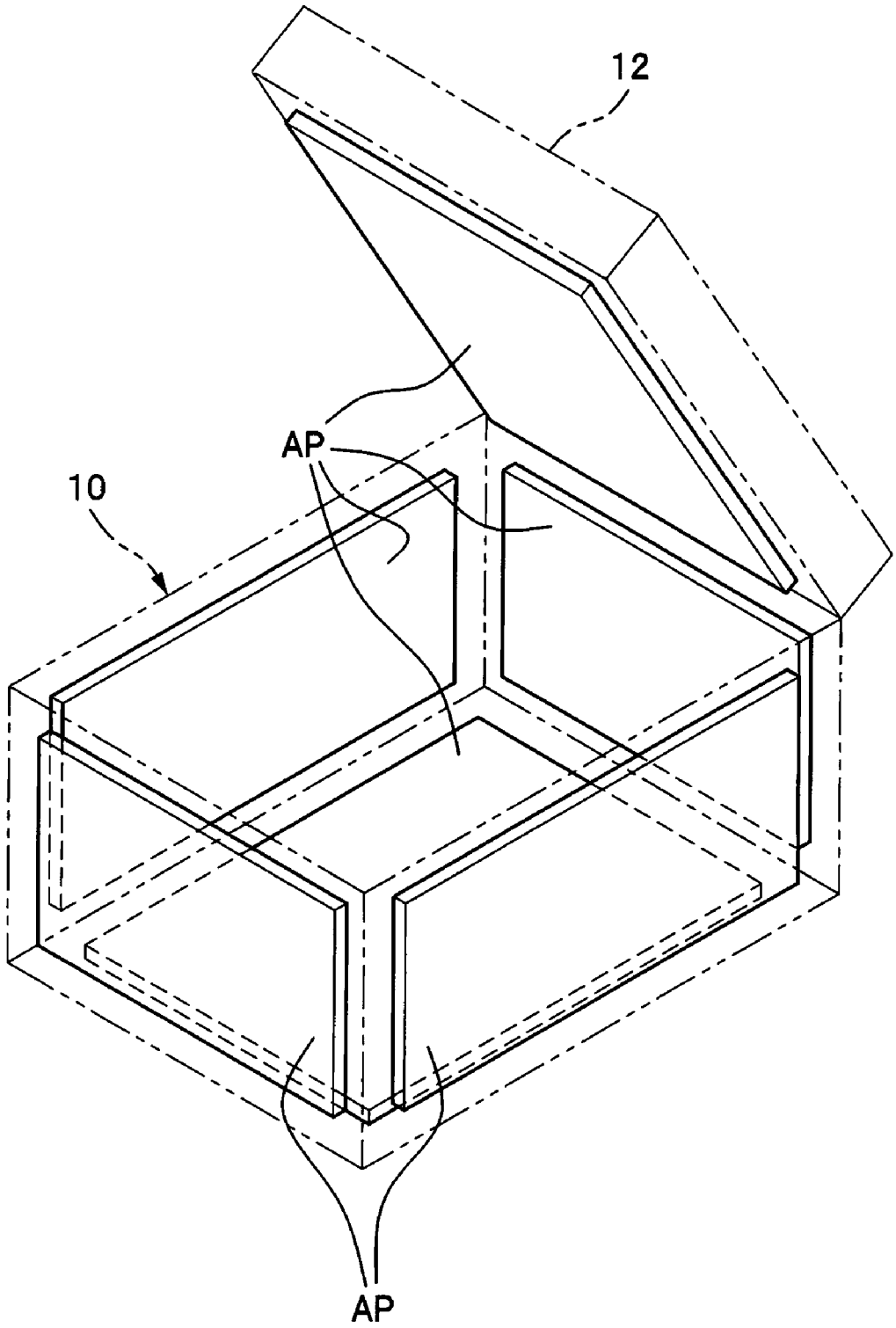
FIG. 9 is a schematic view showing a configuration in which metal panels are disposed on all inner faces of a body case and the upper cover.

Although, in the exemplary embodiment, the metal side frames 15A are disposed only on the right and left walls of the body case 10, the inventive concept of the present invention is not limited thereto. As shown in a schematic view of FIG. 9, metal panels AP may be disposed on the inner faces of all the walls (front, rear, left, right, and bottom walls) of the body case 10, and a metal panel AP may be disposed on the lower face of the upper cover 12. According to this configuration, an LED unit (not shown) is enclosed by a metal in the vertical, lateral, and longitudinal directions. Therefore, the LED unit can be grounded freely in any directions, so that grounding of the LED unit can be performed more surely and easily.

Although, in the exemplary embodiment, the present invention is applied to the color printer 1, the present invention is not limited thereto. The present invention may be applied to another image forming apparatus such as a copier or a multifunction peripheral apparatus.

In the exemplary embodiment, the upper cover 12 which is pivotable with respect to the body case 10 is employed. However, the present invention is not limited thereto. For example, a support member which supports the LED unit in the body case so as to be movable in one direction may be employed.

Although, in the exemplary embodiment, the LED unit 40 is grounded via the positioning units for positioning the LED unit 40 in the lateral direction (the main scanning direction), the present invention is not limited thereto. For example, the LED unit 40 may be grounded via positioning units for positioning the LED unit 40 in the longitudinal direction (the sub scanning direction). Specifically, metal plates in which end portions are connectably engaged with the grounding terminals 42G are integrally formed on the sub scanning direction positioning faces 45E of the resin covers 45 shown in FIG. 3, and one of the front guide 161 and the rear guide 162 is formed by a metal, thereby allowing the LED unit 40 to be grounded via these components.

In the exemplary embodiment, the side frames 15A are employed for grounding the LED unit 40. The present invention is not limited to this. For example, metal cross members 15B may be employed for grounding the LED unit 40.

Although, in the exemplary embodiment, the photosensitive drum 53 is employed as a photosensitive member, the present invention is not limited to this. Alternatively, a belt-like photosensitive member may be employed.

What is claimed is:

1. An image forming apparatus comprising:

a photosensitive member on which an electrostatic latent image is to be formed;

a first body which rotatably supports the photosensitive member;

an exposing unit which exposes the photosensitive member;

a second body which supports the exposing unit movably between an exposing position in which the exposing unit exposes the photosensitive member and a retracting position in which the exposing unit is retracted from the photosensitive member;

a first grounding unit which, when the exposing unit is positioned at the exposing position, causes the exposing unit to be electrically connected to the first body; and a second grounding unit which, when the exposing unit is positioned at the retracting position, causes the exposing unit to be electrically connected to the first body via the second body.

2. The image forming apparatus according to claim 1, wherein the second body includes an end portion about which the second body is pivotably supported by the first body, and wherein the second grounding unit causes the exposing unit to be electrically connected to the first body via the second body.

3. The image forming apparatus according to claim 2, wherein the second grounding unit includes:

a first conductive member disposed in the first body;

a second conductive member disposed in the second body; and a wiring member via which the first conductive member and the second conductive member are connected to each other, and which passes through the end portion of the second body, wherein the exposing unit is supported so as to pivot with respect to the second body in accordance with pivoting movement of the second body, and wherein the exposing unit is separated from the second conductive member when the exposing unit is positioned at the exposing position and in contact with the second conductive member when the exposing unit is positioned at the retracting position by relative movement with respect to the second body.

4. The image forming apparatus according to claim 1, wherein the exposing unit includes a first positioning unit, wherein the first body includes a second positioning unit configured to abut against the first positioning unit to position the exposing unit with respect to the first body, and wherein the first grounding unit causes the exposing unit to be electrically connected via the first positioning unit and the second positioning unit.

5. The image forming apparatus according to claim 4, wherein the first positioning unit and the second positioning unit are disposed on both sides of the exposing unit in an axial direction of the photosensitive member.

6. The image forming apparatus according to claim 1, wherein the exposing unit includes:

a plurality of light emitting portions which selectively emit light;

a resin head which covers the plurality of light emitting portions; and a metal frame which supports the resin head, and wherein the exposing unit is grounded via the metal plate.

7. The image forming apparatus according to claim 6, wherein each of the light emitting portions is a light emitting diode.

8. The image forming apparatus according to claim 1, wherein both of the first body and the second body includes metal so that the exposing unit is enclosed by the metal in vertical, lateral, and longitudinal directions.

9. The image forming apparatus according to claim 6, wherein the metal frame is longer than the resin head in an axial direction of the photosensitive member.

10. An image forming apparatus comprising:

a photosensitive member;

an exposing unit which exposes the photosensitive member;

a first body which supports the photosensitive member, the first body including a first conductive member;

a second body which supports the exposing unit and is movable with respect to the first body between a first state in which the exposing unit opposes the photosensitive member and a second state in which the exposing unit is retracted from the photosensitive member, the second body including a second conductive member;

wherein when the second body is in the first state, the exposing unit is electrically connected to the first conductive member without being connected to the second conductive member, and wherein when the second body is in the second state, the exposing unit is electrically connected to the second conductive member without being connected to the first conductive member.

11. The image forming apparatus according to claim 10, wherein the exposing unit is movable with respect to the second body, and wherein when the second body is in the second state, the exposing unit abuts against the second conductive member.

12. The image forming apparatus according to claim 10, further comprising a positioning unit which positions the exposing unit when the second body is in the first state, wherein when the second body is in the first state, the exposing unit is connected to the first conductive member via the positioning unit.

* * * * *